US005472399A

United States Patent [19]

Szekely

[11] Patent Number: 5,472,399

[45] Date of Patent: Dec. 5, 1995

[54] APPARATUS FOR EXERCISING THE PENIS

[76] Inventor: Andre Szekely, Box 25, Benton Hollow Rd., Woodbourne, N.Y. 12788

[21] Appl. No.: 426,873

[22] Filed: Apr. 24, 1995

[51] Int. Cl.[6] ..... A63B 21/00

[52] U.S. Cl. ..... 482/121; 482/148; 600/38

[58] Field of Search ..... 482/121, 122, 482/124, 79, 80, 30, 31, 32, 44, 148; 600/38–40

[56] References Cited

U.S. PATENT DOCUMENTS 2,830,816 5/1958 Uhl ..... 482/80
3,814,420 6/1974 Encke ..... 482/79
3,937,462 2/1976 Kusmer ..... 482/121
5,069,445 12/1991 Mai ..... 482/30
5,160,303 11/1992 Smith ..... 482/44

*Primary Examiner*—Stephen R. Crow
*Attorney, Agent, or Firm*—Levine & Mandelbaum

[57] ABSTRACT

Apparatus for exercising the penis has a torsion bar with an anchored end and a free end, and a fulcrum rod movably mounted above the torsion bar for adjusting the downward resistive force of the free end. Padding is provided at the free end against which the penis can be flexed for improving circulation and strengthening the muscles to improve and maintain sexual function.

5 Claims, 1 Drawing Sheet

APPARATUS FOR EXERCISING THE PENIS

BACKGROUND OF THE INVENTION

This invention relates to an apparatus for exercising the penis. More specifically, the invention is directed to the construction of apparatus for providing a resistance force against which the penis can be flexed to improve sexual function by increasing blood flow to the penis, strengthening the muscles which are active in the sexual function of the penis, and increasing the circumference of the penis due to the strengthening of the muscles.

Gradual diminution of sexual function in men often occurs with aging. Difficulty in achieving and sustaining an erection is believed to be attributable to loss of circulation of blood to the muscles which control the penis. It is known in the art that exercise by flexing the erect penis against a counterweight is sometimes beneficial in alleviating the aforementioned condition. Until now, there was no device for providing a counter force against which to flex the penis. Towels of different sizes, wet or dry, have been used. However, towel provide little control over the amount of force to be applied. Moreover, it is desirable to begin exercise with a relatively light force and to gradually increase the force as progress is made.

SUMMARY OF THE INVENTION

The aforementioned problems of the prior art are overcome by the instant invention which provides for apparatus for exercising the penis, including a housing having a rear wall and two transverse side walls, torsion bar means having one end fixedly mounted on the rear wall and an opposite free end, fulcrum means mounted above and transverse to the torsion bar means intermediate the one end and the free end, torsion bar adjustment means mounted between the housing and the fulcrum means for varying the resistive downward force whereby the penis can engage the free end for urging it upwardly against the resistive downward force of the torsion bar means, the side walls having parallel slots in which the fulcrum means is mounted above the torsion bar means whereby the fulcrum means can be moved along the slots, releasable locking means for fixing the fulcrum means in the slots during use of the exerciser and for releasing the fulcrum means to enable movement along the slots, the releasable locking means including a threaded knob and the fulcrum means including a rod having an end threaded for receiving the knob, and padded means mounted on the free end of the torsion means for comfortably engaging the penis.

It is therefore an object of the invention to provide a device for improving and maintaining sexual performance of men.

Another object of the invention is to provide a device for exercising a counter force against the penis as it is flexed.

Still another object of the invention is to provide an exercise device for exerting a force against the penis which increases with degree of flexing.

A further object of the invention is to provide an exercise device for the penis in which the degree of resistive force applied can be continuously adjusted.

Still a further object of the invention is to provide an exercise device for the penis which can be comfortably used without discomfort or pain.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
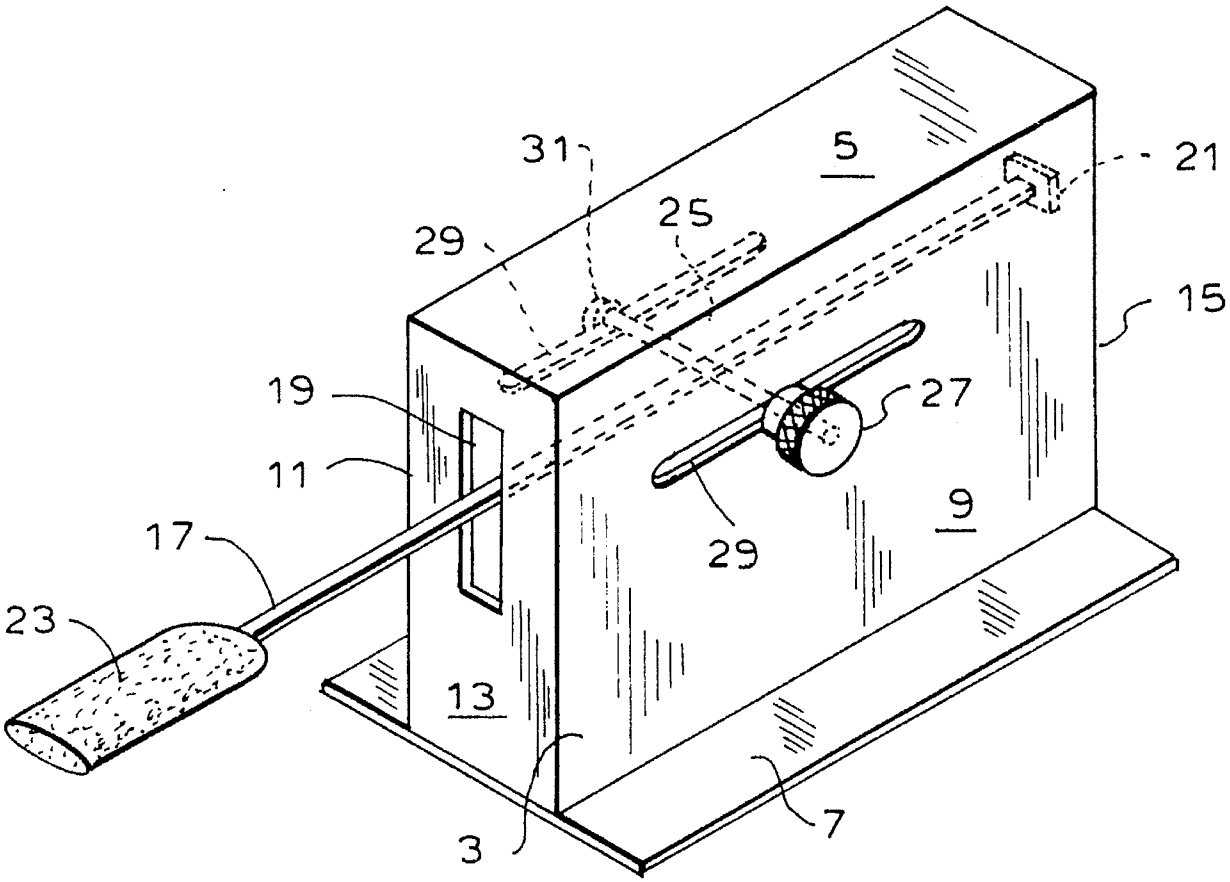
FIG. 1 is a perspective view of apparatus for exercising the penis in accordance with the preferred embodiment of the invention.

Referring now to FIG. 1, there is shown a penis exerciser 1 having a top wall 5, left side wall 9, right side wall 11, front wall 13, rear wall 15, and bottom platform 7. Disposed in the front wall 13 is an elongated rectangular torsion bar slot 19 running in the vertical direction along a center axis of the front wall 13.

Mounted on the interior of the rear wall 15 is a torsion bar anchor 21. Extending from the torsion bar anchor 21, and through the torsion bar slot 19, in a direction parallel to the bottom platform 7 and top wall 5 is a torsion bar 17. The torsion bar 17 is preferably made from a spring steel material having good resilience. Mounted on the free end of the torsion bar 17 outside of the housing 3 is a torsion bar pad 23 made of a soft material for comfortably engaging the penis.

The left side wall 9 and right side wall 11 are provided with respective fulcrum rod adjustment slots 29 for receiving a fulcrum rod 25 mounted transversely to, and above, the torsion bar 17. That is, the fulcrum rod 25 is disposed between the torsion bar 17 and the top wall 5. The elevation of the fulcrum rod adjustment slots 29 is such that their lower edges are at substantially the same elevation as the uppermost surface of the torsion bar 17 where it engages the torsion bar anchor 21. The torsion bar 17 is suspended below the fulcrum rod 25 with the length of the torsion bar 17 between the fulcrum rod 25 and torsion bar anchor 21 parallel to the fulcrum rod adjustment slots 29, bottom platform 7, and top wall 5.

Affixed to one end of the fulcrum rod 25 which extends beyond the right side wall 11 is an enlargement 31 which serves as a fulcrum rod retainer. The opposite end of the fulcrum rod 25 is threaded a receive a fulcrum rod locking knob 27 having a complementary thread. The fulcrum rod locking knob 27 is loosened for moving the fulcrum rod 25 along the fulcrum rod adjustment slots 29 for changing the fulcrum point at which the torsion bar 17 is engaged by the fulcrum rod 25 for adjusting the spring force at the torsion bar pad 23. The fulcrum rod locking knob 27 is tightened to retain the fulcrum rod 25 in place when the desired resistance force for the torsion bar 17 at the torsion bar pad 23 is obtained. Calibration marks (not shown) may be imprinted along the fulcrum rod adjustment slots 29 to indicate the degree of resistance at the torsion bar pad 23.

The bottom platform 7 preferably extends beyond the walls 9, 11 for stabilizing the penis exerciser 1 in the lateral direction. The housing 3 can be fabricated from most rigid materials, preferably plastic or metal. Depending on the weight of the penis exerciser 1, it may be desirable to employ fasteners between the bottom platform 7 and the floor on which the penis exerciser 1 is to be stood for preventing the housing 3 from being lifted off the floor during flexing of the penis.

In use, the erect penis is placed beneath the torsion bar pad 23 and repeatedly flexed and relaxed. As the penis is flexed, it moves upwardly against the opposing downward force of the torsion bar pad 23 due to the resilience of the torsion bar 17. An exercise program usually begins with the fulcrum rod 25 set toward the rear wall 15. As muscle strength increases, the fulcrum rod 25 is progressively positioned nearer to the front wall 13.

It is to be appreciated that the foregoing is a description of a preferred embodiment of the invention to which variations and modifications may be made without departing from the spirit and scope of the invention.

What is claimed is:

1. Apparatus for exercising the penis comprising a housing having a rear wall and two transverse side walls, resilient torsion bar means having one end fixedly mounted on said rear wall and an opposite free end, fulcrum means mounted on said housing above and transverse to said torsion bar means intermediate said one end means mounted on the free end of said torsion means for comfortably engaging the penis and said free end, whereby the penis can engage said free end for urging it upwardly against a resistive downward force of said torsion bar means.

2. Apparatus according to claim 1 further comprising torsion bar adjustment means mounted between said housing and said fulcrum means for varying said resistive downward force.

3. Apparatus according to claim 2 wherein said side walls have parallel slots and said fulcrum means is mounted within the slots for movement therealong for varying said resistive downward force.

4. Apparatus according to claim 3 further comprising releasable locking means for fixing said fulcrum means at one position in said slots during use of said exerciser and for releasing said fulcrum means to enable movement along said slots to a different position for varying said resistive downward force.

5. Apparatus according to claim 4 wherein said releasable locking means comprises a threaded knob and said fulcrum means comprises a rod having an end threaded for receiving said knob.

* * * * *